US007748474B2

(12) United States Patent
Watkins et al.

(10) Patent No.: US 7,748,474 B2
(45) Date of Patent: Jul. 6, 2010

(54) ACTIVE VIBRATION CONTROL FOR SUBTERRANEAN DRILLING OPERATIONS

(75) Inventors: Larry Watkins, Houston, TX (US); Roger W. Fincher, Conroe, TX (US); Peter Aronstam, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 27 days.

(21) Appl. No.: 11/471,231

(22) Filed: Jun. 20, 2006

(65) Prior Publication Data

US 2007/0289778 A1 Dec. 20, 2007

(51) Int. Cl.
*E21B 7/27* (2006.01)

(52) U.S. Cl. ..... 175/56; 175/57; 175/40

(58) Field of Classification Search ..... 175/56, 175/57, 320, 40
See application file for complete search history.

(56) References Cited

U.S. PATENT DOCUMENTS 3,230,740 A * 1/1966 Fox ..... 464/18
4,261,425 A 4/1981 Bodine
4,522,271 A * 6/1985 Bodine et al. ..... 175/56
4,788,467 A * 11/1988 Plambeck ..... 310/323.01
4,815,328 A 3/1989 Bodine
4,905,776 A * 3/1990 Beynet et al. ..... 175/56
5,117,926 A * 6/1992 Worrall et al. ..... 175/56
5,454,451 A * 10/1995 Kawamata et al. ..... 188/267.1
5,562,169 A 10/1996 Barrow
5,595,254 A 1/1997 Tibbitts
5,678,460 A 10/1997 Walkowc
5,947,214 A 9/1999 Tibbitts
5,988,336 A * 11/1999 Wendt et al. ..... 192/21.5
6,009,948 A * 1/2000 Flanders et al. ..... 166/301
6,182,774 B1 2/2001 Tibbitts
6,227,044 B1 * 5/2001 Jarvis ..... 73/152.47
6,233,524 B1 5/2001 Harrell et al.
6,308,940 B1 * 10/2001 Anderson ..... 267/125
6,325,163 B2 12/2001 Tibbitts
6,338,390 B1 1/2002 Tibbitts
6,357,538 B2 3/2002 Tibbitts
6,424,079 B1 7/2002 Carroll
6,445,012 B2 9/2002 Takahashi et al.
6,453,323 B1 9/2002 Hoshino et al.
6,594,881 B2 7/2003 Tibbitts
6,648,081 B2 11/2003 Fincher et al.
7,036,612 B1 * 5/2006 Raymond et al. ..... 175/321
7,219,752 B2 5/2007 Wassell et al.

(Continued)

*Primary Examiner*—David J Bagnell
*Assistant Examiner*—Cathleen R Hutchins
(74) *Attorney, Agent, or Firm*—Madan & Sriram, P.C.

(57) ABSTRACT

An active vibration control device improves drilling by actively applying a dampening profile and/or a controlled vibration to a drill string and/or bottomhole assembly (BHA). Embodiments of the present invention control the behavior of a drill string and/or BHA in order to prevent or minimize the occurrence of harmful drill string/BHA motion and/or to apply a vibration to the drill string/BHA that improves one or more aspects of the drilling process. Measurements of one or more selected parameters of interest are processed to determine whether the undesirable vibration or motion is present in the drill string or BHA and/or whether the drill string and/or BHA operation can be improved by the application of a controlled vibration. If either or both conditions are detected, corrective action is formulated and appropriate control signals are transmitted to one or more devices in the drill string and/or BHA.

13 Claims, 8 Drawing Sheets

U.S. PATENT DOCUMENTS

| | | | | |
|---|---|---|---|---|
| 7,261,167 | B2 * | 8/2007 | Goldman et al. | 175/39 |
| 7,341,116 | B2 * | 3/2008 | Fincher et al. | 175/57 |
| 2001/0020551 | A1 * | 9/2001 | Taylor et al. | 175/57 |
| 2002/0094373 | A1 | 7/2002 | Szalony | |
| 2002/0144873 | A1 | 10/2002 | Kato et al. | |
| 2004/0149492 | A1 * | 8/2004 | Taylor et al. | 175/57 |
| 2004/0238219 | A1 * | 12/2004 | Nichols et al. | 175/57 |
| 2005/0047854 | A1 | 3/2005 | Walworth et al. | |
| 2005/0056463 | A1 * | 3/2005 | Aronstam et al. | 175/61 |
| 2005/0087408 | A1 * | 4/2005 | Namuduri et al. | 188/267.1 |
| 2005/0121269 | A1 * | 6/2005 | Namuduri | 188/267.1 |
| 2005/0194183 | A1 | 9/2005 | Gleitman et al. | |
| 2005/0230211 | A1 | 10/2005 | Weilant | |
| 2005/0258090 | A1 | 11/2005 | Gernon | |
| 2006/0243489 | A1 * | 11/2006 | Wassell et al. | 175/57 |
| 2007/0144842 | A1 * | 6/2007 | Zhou | 188/267 |
| 2007/0221408 | A1 * | 9/2007 | Hall et al. | 175/57 |
| 2007/0284148 | A1 * | 12/2007 | Wassell et al. | 175/65 |
| 2007/0289778 | A1 | 12/2007 | Watkins et al. | |

* cited by examiner

ACTIVE VIBRATION CONTROL FOR SUBTERRANEAN DRILLING OPERATIONS

BACKGROUND OF THE INVENTION

1. Field of the Invention

In one aspect, this invention relates generally to systems and methods for controlling the behavior or motion of a drill string and/or bottomhole assembly to optimize drilling operations.

2. Description of Related Art

To obtain hydrocarbons such as oil and gas, boreholes are drilled by rotating a drill bit attached at a drill string end. Conventionally, the drill bit is rotated by rotating the drill string using a rotary table at the surface and/or by using a drilling motor in a bottomhole assembly (BHA). As can be appreciated, the cutting action of the drill bit against the earthen formation and the rotation of the drill string within the wellbore can produce a number of vibrations and motion that can cause a number of non-beneficial conditions such as a reduction in the effectiveness of the cutting action, damage to tooling, reduction in tool life, impairment of the effectiveness of downhole tools, etc.

Conventionally, a number of solutions have been applied to handle these non-beneficial conditions. For example, some tools are provided with housings or other structures that attempt to isolate the tooling from shock and vibrations. Other solutions include positioning tooling in areas where vibrations are expected to be the lowest. Additionally, tooling such as passive shock absorbers and stabilizers have been devised to absorb or ameliorate potentially harmful vibrations and motion. One drawback to such conventional systems is that they cannot in a real time or near real time basis adapt to the dynamic drilling environment. For example, a conventional shock absorber is constructed to have a fixed range of frequency and amplitude absorption. Such a shock absorber may have diminished value if the damaging vibrations are outside the range of the pre-set frequency and amplitude.

Another solution to handling damaging vibrations and motions is to alter drilling parameters such as weight on bit, drill bit rotation speed, drilling fluid flow rate, etc. until the damaging vibrations are minimized. It will be appreciated, however, that such alterations may result in drilling at non-optimal conditions, e.g., reduced rate of penetration.

The present invention address these and other needs relating to the above-described problems.

SUMMARY OF THE INVENTION

The present invention provides systems, methods and devices for improving the drilling process by actively applying a dampening profile and/or a controlled vibration to a drill string and/or bottomhole assembly (BHA). Embodiments of the present invention control the behavior of a drill string and/or BHA in order to prevent or minimize the occurrence of harmful drill string/BHA motion and/or to apply a dampening profile and/or a vibration to the drill string /BHA that improves one or more aspects of the drilling process (e.g., borehole quality, tool life, rate of penetration, etc.).

In one application, measurements of one or more selected parameters of interest are taken along one or more locations of a drill string or BHA during drilling and processed to determine whether an undesirable vibration or motion is present in the drill string or BHA. This processed data can also be used to determine whether the drill string and/or BHA operation can be improved by the application of a dampening profile and/or a controlled vibration. If the processed data indicates that improvement of conditions is possible, then corrective action is formulated and appropriate control signals are transmitted to one or more devices in the drill string and/or BHA to generate vibrations that minimize the undesirable vibration and/or improve operation of the drill string and/or BHA.

Exemplary measurements include measurements of parameters such as axial vibration, torsional vibration, drill string whirl, bit bounce, slip-stick, and other motion that, if of sufficient magnitude and duration, could damage the borehole, drill string and/or BHA. A downhole and/or surface processing unit can utilize any number of schemes for processing the measurement data. In one arrangement, pre-run modeling of the BHA and drill string is done to define optimal tool signatures, optimal drilling parameters, and out-of-norm vibration levels. The measurement data is processed and compared against the pre-run modeling to determine the nature and extent of any non-optimal or out of norm conditions (hereafter "non-beneficial condition"), if any. A suitable service for measuring downhole BHA vibrations is CO-PILOT available from BAKER HUGHES INCORPORATED.

Exemplary corrective action can include causing the active vibration device to apply a dampening profile and/or an active vibration over a range of frequencies and measure the drill string and/or BHA response to determine a minima of vibration and the corresponding frequency of the applied vibration. In another arrangement, a pre-set frequency is applied upon detection of a specified non-beneficial condition. In another arrangement, predictive models can calculate the value of one or more vibration frequencies that may alleviate the non-beneficial condition and/or a dynamic learning module can be used to determine the effectiveness of an applied frequency and adjusts the corrective action accordingly.

Embodiments of the present invention can be used with a drilling system including a conventional surface rig that conveys a drill string and a conventional BHA into a wellbore. The string can include jointed drill pipe or coiled tubing. The BHA includes a sensor package for measuring one or more parameters of interest. Suitable sensors also include sensors that provide real-time drilling dynamics and performance information such as stresses, pressures, multi-axis accelerations and multi-axis vibrations. Additionally, one or more sensors can be distributed in and along the drill string.

In one embodiment, a control unit in conjunction with one or more active vibration control devices applies a selected dampening profile and/or a selected vibration to the drill string and/or BHA. The control unit selects operating parameters for the active dampening and/or active vibration control device that cause the active vibration control device to generate a dampening response and/or a vibration that is calculated to mitigate a detected non-beneficial condition. In one embodiment, the control unit includes a calculation engine module adapted to process sensor data and determine corrective action. The calculation engine module can be at the surface and/or downhole. The calculation engine module can be set to manage drilling performance (efficiency) or mitigate harmful motion/vibration or some blend of both. Additionally, for managing drilling performance, the control unit can include a drilling efficiency enhancement driver module to enhance the drilling efficiency.

An exemplary active vibration control device has relatively fast response and can operate in axial, lateral and torsional modes. A single device need not provide all three modes of vibration cancellation nor do separate devices have to separately provide each mode of operation. The active vibration control device can include one or more materials having properties that in response to an excitation or control signal produce controlled dampening or oscillations in the required frequency range, hereafter "controllable" materials.

One Illustrative embodiment of active vibration control device includes one or more biasing elements and a damping chamber that dampens unwanted axial motions. The biasing element has a wide ranging 'K factor (spring coefficient) for different operations and transfers compression and tension forces through the device without disabling the freedom of axial travel within the device. The damping chamber is connected to the biasing element and includes a controllable fluid. By adjusting a material property of the controllable fluid, the coefficient of damping provided by the chamber can be increased or decreased. By controlling combinations of displacement and velocity, the control unit can control axial vibrations and resulting accelerations in the drill string and/or BHA.

Another illustrative embodiment of active vibration control device includes a mass that is selectively coupled to the drill string with a coupling device. An excitation device causes the mass to oscillate along an axis co-linear to the axis of the drill string. The mass is driven by an external or an internal source. The device is controlled by a calculation engine module in a control unit. In response to the calculation engine module commands, the coupling device temporarily couples the moving mass to the drill string. The degree of coupling and the duration of the coupling control the energy transferred from the moving suspended mass into the drill string. If the mass and drill string travel in a common direction, then the energy causes a user selected motion/vibration. If the mass and drill string move in opposing directions, then the energy transfer actively cancels motion/vibrations. The coupling device can use controllable fluids, magnets and electric coils, or a mechanical clutch arrangement to connect the mass to the drill string.

Aspects of the present invention also include active torsional damping devices.

An illustrative embodiment of an active torsional damping device includes couplings that have mating circumferentially spaced-apart claws. The device is connected at one end to a driving upper sub and connected at another end to a driven lower sub. Biasing elements couple the claws of each coupling so that when torque is applied in either direction, one half of the biasing elements are compressed and one half are partially unloaded. The biasing elements are surrounded with a controllable fluid. Changing a material property such as the stiffness or viscosity of the controllable fluid adjusts the rate of loading or unloading of the biasing elements and can cause a momentary change in the rate of rotation between the upper sub and lower sub, which can be used to dampen torsional shock loads and forces and/or impart torsional vibration.

In variants, a fluid between a pair of chambers can be controlled to alter the relative volume of the chambers and thereby permit momentary relative rotation between the upper and lower subs. In another variation, the biasing elements include pairs of bow or leaf spring whose long axis is aligned with the axis of the drill string and are loaded (e.g., compressed) as torque to the drill string is applied.

In another illustrative embodiment, an active torsional vibration device utilizes one or more friction disks that have a rotation axis that is aligned with the drill string axis. The single or stack of multiple friction disks can be loaded by a passive spring force unit and also loaded with an active loading device to control the maximum torque transmitted and the moment-by-moment torque to control of torsional events. In some embodiments, additional active damping is provided by placing the disks within a chamber that is filled with a controllable fluid. Actively changing the properties (viscosity and/or shear strength) of these fluids provides corresponding active control over the rate of disk slippage between the clutch disks and the end subs. By adjusting the rate of slippage between the disks, the resulting corresponding momentary change in the rate of rotation between the upper and lower sub can be used to dampen torsional shock loads and forces. In another arrangement, a low amount of slippage is allowed such that momentary removal of the slippage causes a controlled torsional vibration.

In another illustrative embodiment, an active torsional vibration control device includes a fluid drive torque converter positioned between an upper driving sub and a lower driven sub. The fluid torque converter controls the torsional coupling of the subs with a controllable fluid having a property such as stiffness or viscosity that can be adjusted. Application of control signals to the controllable fluid properties increases the amount of torque transmitted across the device by increasing the shear strength of the fluid. Upon appropriate application of control signals, the torque converter can momentarily 'slip' (a fraction of a rotation) to dampen torsional shock loads and forces in a manner previously described. In another application, the torque converter can create beneficial torsional vibrations by allowing a baseline degree of continuous slip across the driven sub versus the driving sub. Control signal can be applied to the controllable fluid to momentarily remove most, if not all, of the slip. This causes a slight reduction in the slip between the rotation source and the driven sub and thus applies a speed spike to the driven sub.

Exemplary devices to actively control and manage or impart beneficial torsional vibrations into the drill string and/or BHA also include systems incorporating flywheels and torsional spring masses.

An illustrative embodiment of a flywheel system includes a spinning mass made of high density material surrounded by a controllable fluid. The flywheel system can include a toroidal cylinder spinning at high speed within a sub placed in a section of a drill string. A control unit applies a control signal that selectively increases the viscosity of the controllable fluid, which increases the drag between the cylinder and the sub. By momentarily coupling the spinning cylinder to the sub, energy in the form of vibrations can be imparted into the sub and the drill string. If the cylinder and drill string rotate in the same direction, the momentary coupling creates a torque or speed spike. In a counter rotation scenario, momentary coupling dampens torque or speed spike in the direction of the string rotation. Also, a pair of controlled coupled counter spinning flywheels can be used to arrest torsional vibrations in either direction.

In another illustrative embodiment, an active torsional control device includes a relatively heavy cylindrical mass mounted between two counter wound torsional springs. The mass is placed in an annular sub such that it is free to rotate in an oscillatory fashion around the long axis of the drill string or BHA. A controllable fluid surrounds the mass and springs and an energy source keeps the mass torsionally oscillating. As discussed above, the control unit determines the energy level needed to damp or control certain or series of torsional vibrations. Sensors monitor the direction and angular velocity of the torsional mass and this information is used by the control unit to determine and calculate the required degree of coupling between the torsional mass and the sub.

Embodiments of the present invention can also be advantageously used to control whirling of the drill string.

An illustrative embodiment of an active whirl control device is formed somewhat like a near full gage drill string stabilizer that is not rigidly attached to the drill pipe. The device includes one or more coupling elements that actively connect the device to the drill string. The device allows the drill string to 'wobble' such that the device axial center and drilling string axial center do not have to be co-linear. The device also includes contact pads that are relatively short and close to full gage. The coupling devices include a group of chambers dispersed circumferentially in an annular space separating the drill pipe and the device. The chambers expand or contract as needed to dampen or stop the drill string from whirling. The chambers are filled with a controllable fluid. Using a control signal, the properties of these fluids and the flow of these fluids between chambers are actively altered to affect the damping action. In some embodiments, sensors are placed in and around the chambers to monitor and allow real-time control of the active and self-contained whirl damping device.

Active drill string whirl control devices can be independent or integral to other active devices. Additionally, these devices can be placed in single or multiple locations along the drill string and bottom hole assembly.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE INVENTION

Figure 1:
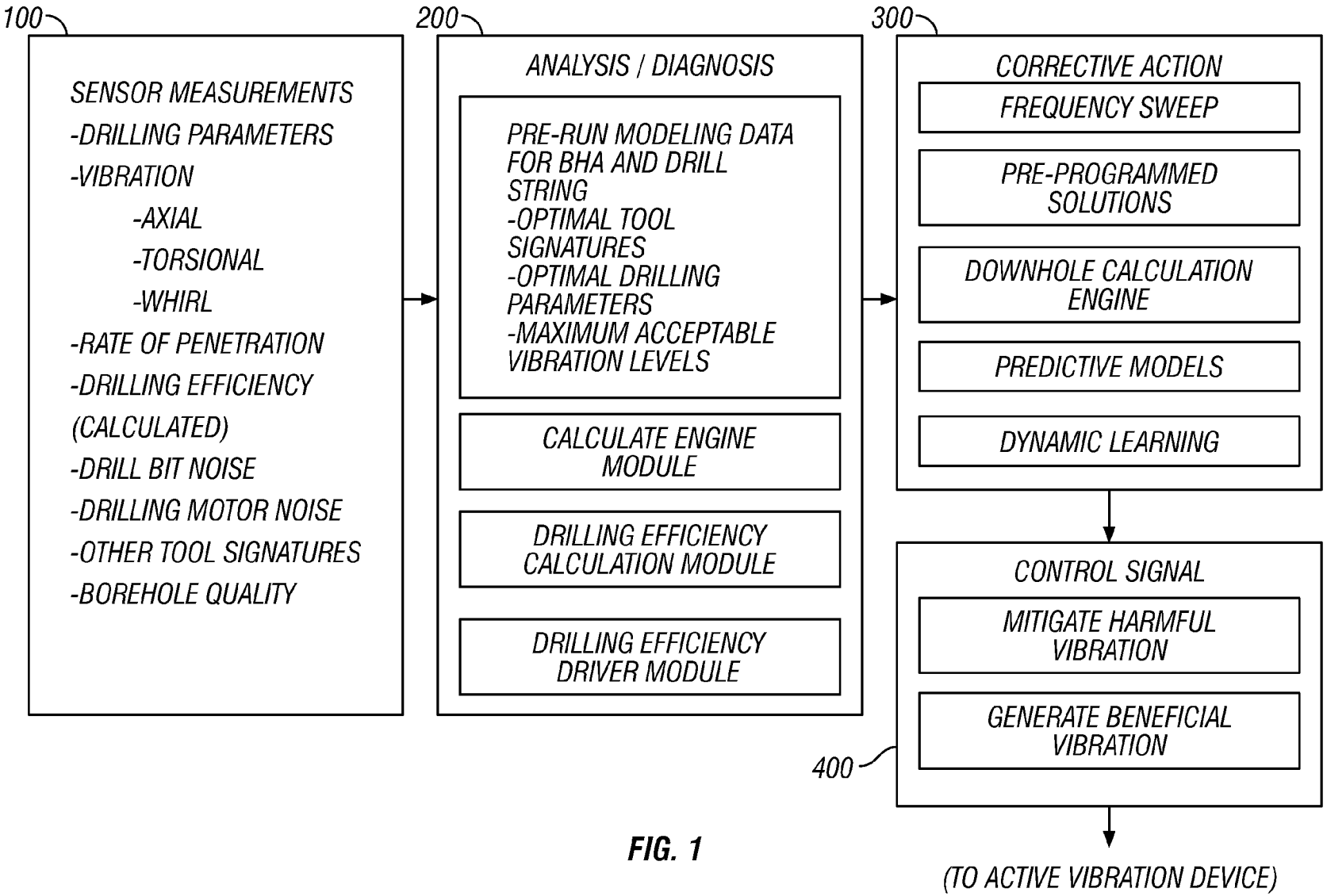
FIG. 1 illustrates in flow chart form one exemplary control methodology for actively applying vibrations to a drill string or BHA.

The teachings of the present invention can be applied in a number of arrangements to generally improve the drilling process by actively applying a dampening profile and/or a controlled vibration to a drill string and/or bottomhole assembly (BHA). Such improvements may include improvement in ROP, extended drill string life, improved bit and cutter life, reduction in wear and tear on BHA, and an improvement in bore hole quality. The term vibration as used herein refers generally to motion of a body but is not meant to imply an particular type of motion or time duration for the motion. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Embodiments of the present invention control the behavior of a drill string and/or bottomhole assembly (BHA) in order to prevent or minimize the occurrence of harmful drill string/BHA motion and/or to apply a vibration to the drill string/BHA that improves one or more aspects of the drilling process (e.g., borehole quality, tool life, rate of penetration, etc.).

Referring initially to FIG. 1, there is shown a flow chart illustrating one application of the teachings of the present invention. During drilling, measurements 100 of one or more selected parameters of interest are taken along one or more locations of a drill string or BHA. These sensor measurements are processed 200 to determine whether undesirable vibration or motion is present in the drill string or BHA and/or whether the drill string and/or BHA operation can be improved by the application of a dampening profile and/or a controlled vibration. If the processed data indicates that either or both conditions exist, the nature of the corrective action 300 is formulated and appropriate control signals 400 are transmitted to one or more devices in the drill string and/or BHA to minimize the undesirable vibration and/or generate a vibration that improves operation of the drill string and/or BHA.

Exemplary measurements 100 include measurements of parameters such as axial vibration, torsional vibration, drill string whirl, bit bounce, slip-stick, and other motion that, if of sufficient magnitude and duration, could damage the drill string and/or BHA. Other measurements include parameters such as drilling rate of penetration (ROP) and borehole quality that can affect the overall cost of drilling the wellbore. These measurements can be taken continuously, on specified intervals, or as-needed and transmitted to a surface and/or downhole processing unit for analysis 200. The processing unit can utilize any number of schemes for processing the measurement data. In one arrangement, pre-run modeling of the BHA and drill string is done to define optimal tool signatures, optimal drilling parameters, and out-of-norm vibration levels. The measurement data is processed and compared against the pre-run modeling to determine the nature and extent of any non-optimal or out of norm conditions (hereafter "non-beneficial condition"), if any.

Figure 2:
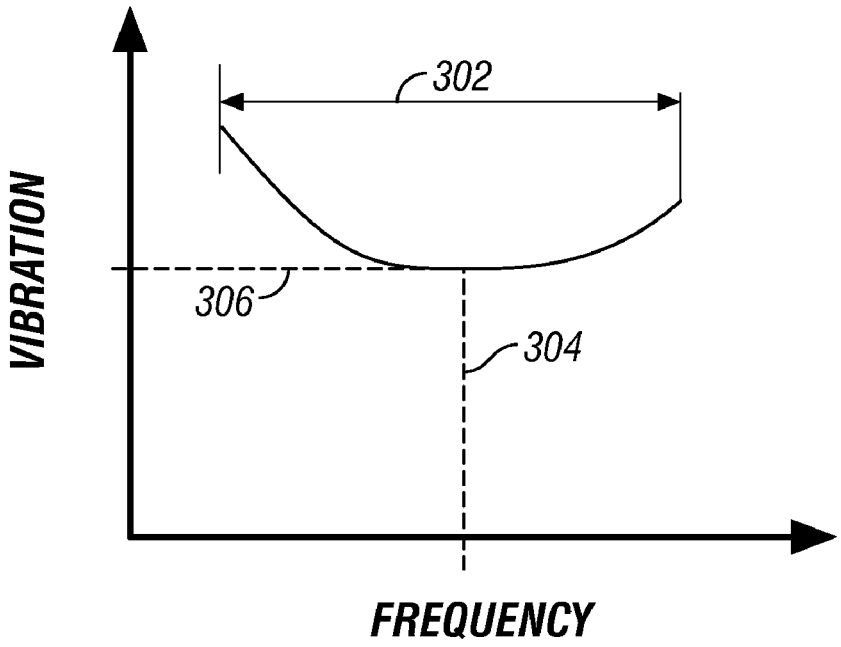
FIG. 2 graphically illustrates an exemplary frequency sweep made in accordance with the FIG. 1 methodology.

If needed, the processing unit initiates corrective action 300 to address the non-beneficial condition by operating an active vibration device, which is discussed in detail below. In one arrangement, the processing unit can cause the active vibration device to apply a dampening profile and/or vibration over a range of frequencies and measure the drill string and/or BHA response to determine whether the non-beneficial condition has been alleviated. Merely for illustration, there is shown in FIG. 2 a graph of a frequency sweep 302. In FIG. 2, the ordinate is the frequency of an applied vibration and the abscissa is the measured parameter of interest such as vibration, amplitude and/or energy level. As shown in FIG. 2, a minima of vibration 304 occurs at a frequency 306 of the applied vibration. Thus, the processing unit transmits a control signal 400 (FIG. 1) that operates the active vibration device at or near the frequency 306. In one sense, the processor unit can be viewed as applying an inverse of the energy spectrum in an effort to damp the vibration profile to an acceptable level. In another arrangement, a pre-set frequency is applied upon detection of a specified non-beneficial condition. In another arrangement, predictive models using the measurement data and/or processed measurement data can calculate the value of one or more vibration frequencies that may alleviate the non-beneficial condition. In yet another arrangement, the downhole processor can include a dynamic learning module that quantifies the effectiveness of an applied frequency and adjusts the corrective action (e.g., frequency sweep, pre-programmed solution, predictive modeling, etc.) accordingly.

The effectiveness of the corrective action can be periodically checked in successive frequency sweeps. Periodicity of corrective action such as a frequency sweep can be based on one or more elements of the drilling operation such as a change in formation, a change in measured ROP, detection of a pre-determined condition, and/or a predetermined time period or instruction from the surface.

Figure 3:
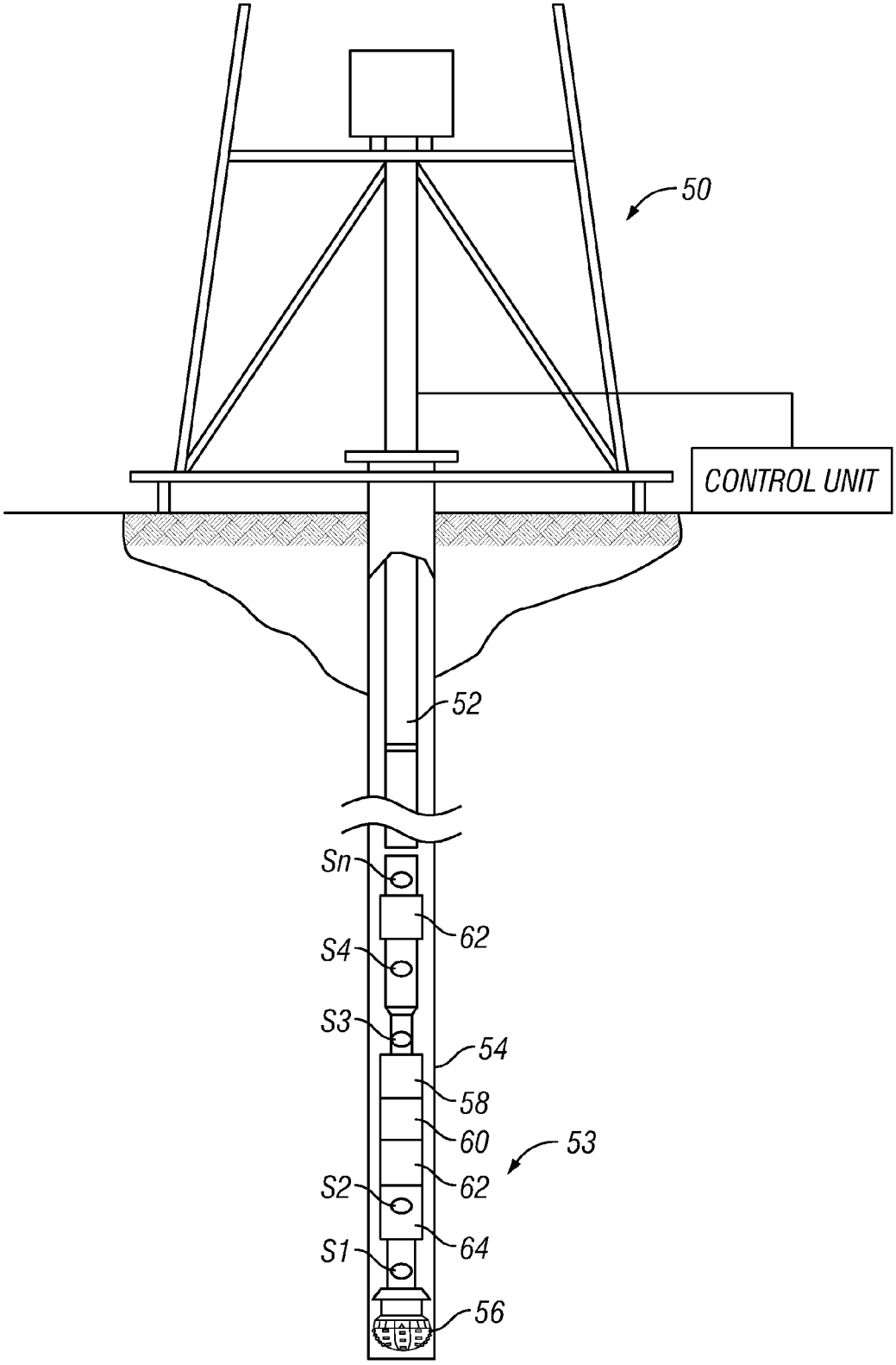
FIG. 3 schematically illustrates an elevation view of a drilling system made according to one embodiment of the present invention.

Aspects of the FIG. 1 embodiment are best understood in connection with FIG. 3, which shows a drilling system including a conventional surface rig 50 that conveys a drill string 52 and a bottomhole assembly (BHA) 53 into a wellbore 54 in a conventional manner. The BHA 53 includes a drill bit 56 for forming the wellbore 54 as well as other known devices such as drilling motors, steering units, and formation evaluation tools. Depending on the application, the device for providing rotary power to the drill bit 56 can be the drill string 52, a drilling motor (not shown), or a combination of these devices. The BHA 53 includes a sensor package 58 for measuring one or more parameters of interest (e.g., rate of penetration, rotational speed, weight-on-bit, torsional oscillation, etc.). Suitable sensors also include sensors that provide real-time drilling dynamics and performance information such as stresses, pressures, multi-axis accelerations and multi-axis vibrations. The sensor package 58 can include software algorithms that determine the occurrence and severity of various downhole drilling dysfunctions (e.g., stick-slip, bit bounce, BHA whirl, etc.). Exemplary sensors and tools include the CO-PILOT MWD service from Baker Hughes Incorporated. Additionally, one or more sensors S1,S2,S3 . . . Sn can be distributed in and along the drill string.

A number of arrangements can be used to create vibrations or oscillations that counter a non-beneficial condition shifting a drill string or BHA condition from a non-optimal condition to a optimal or near optimal condition and/or mitigating one or more out of norm conditions. The terms vibrations and oscillation will be used interchangeably hereafter.

In one embodiment, a control unit 60 in conjunction with one or more active vibration control devices 62 applies a set of forces, displacements and/or frequencies to the drill string and/or BHA. Merely for convenience, such forces, displacements and frequencies will generally be referred to as vibrations. The control unit 60 selects operating parameters for the active vibration control device 62 that cause the active vibration control device 62 to generate a vibration that is calculated to mitigate a detected non-beneficial condition.

The control unit 60 can include a downhole processor and/or the surface processor that includes some or all of the processing, analyzing and communication capabilities discussed in FIG. 1. The processor(s) can be microprocessor that uses a computer program implemented on a suitable machine readable medium that enables the processor to perform the control and processing. The machine readable medium may include ROMs, EPROMs, EAROMs, Flash Memories and Optical disks. Other equipment such as power and data buses, power supplies, and the like will be apparent to one skilled in the art.

In one embodiment, the control unit 60 includes a calculation engine module adapted to process sensor data and determine corrective action as discussed in connection with FIG. 1. The calculation module can be pre-programmed with BHA and drill string geometry data and the location of the sensor data from within the BHA and drill string. Pre-programmed code enables the calculation mode to execute calculations that predict the system behavior of the BHA and drill string. Using these calculations the real-time behavior of the drill string and BHA can be characterized. Coupling of this knowledge with knowledge of the predicted behavior of the system from pre-run modeling allows the calculation engine module to further understand the current real time behavior of the BHA and drill string. Using the combined knowledge of the most likely real-time behavior, the calculation engine module can determine the set of forces, displacements and frequencies to be applied by one or more of the active vibration control devices.

The calculation engine module can be configured to employ one or a combination of several user selectable control methodologies. Generally speaking, the calculation engine module can be set to manage drilling performance (efficiency) or mitigate harmful motion/vibration or some blend of both. As discussed earlier, mitigation of potentially damaging motion can be accomplished by imparting beneficial vibrations into the drilling system that cancel or reduce the damaging vibrations.

For managing drilling performance, the control unit 60 can include a drilling efficiency enhancement driver module as discussed previously. Using sensor measurement data and other input in real-time, this driver module is programmed to monitor drilling efficiency as defined by specific energy required to penetrate a given volume of rock divided by energy provided to the drilling system during this period of time. Using both predictive techniques and optionally real-time optimum parameter searching, the calculation engine module would alter the control signal provided to one or more active vibration control devices so as to super impose a non-damaging and controlled torsional and/or axial oscillation (vibration) on to the BHA to enhance the drilling efficiency as defined above.

In one embodiment, the active vibration control device is an active device that is capable of relatively fast response and can operate in axial, lateral and torsional modes. A single device need not provide all three modes of vibration cancellation nor do separate devices have to separately provide each mode of operation. By "active" it is meant that the device reacts to real-time dynamics of the BHA and drill string by adding energy (e.g., applying vibrations) that improves those dynamics in some manner if needed. By "relatively fast" it is meant that the active vibration control device can apply corrective action to a detected a non-beneficial condition quickly enough to alleviate that non-beneficial condition.

The active vibration control device can include of one or more materials having properties (volume, shape, deflection, elasticity, etc.) that exhibit a predictable response to an excitation or control signal. Suitable materials include, but are not limited to, electrorheological (ER) material that are responsive to electrical current, magnetorheological (MR) fluids that are responsive to a magnetic field, piezoelectric materials that responsive to an electrical current, electro-responsive polymers, flexible piezoelectric fibers and materials, and magneto-strictive materials. This change can be a change in dimension, size, shape, viscosity, or other material property. Additionally, the material is formulated to exhibit the change within milliseconds of being subjected to the excitation signal/field. Thus, in response to a given command signal, the requisite field/signal production and corresponding material property can occur within a few milliseconds. Thus, hundreds of command signals can be issued in, for instance, one minute. Accordingly, command signals can be issued at a frequency ranging from a small fractional to a large multiple of conventional drill strings and/or drill bits (i.e., several hundred RPM). The fluid or material response can be controlled to actively dampen unwanted vibrations and/or produce controlled oscillations in the required frequency range.

Figure 4:
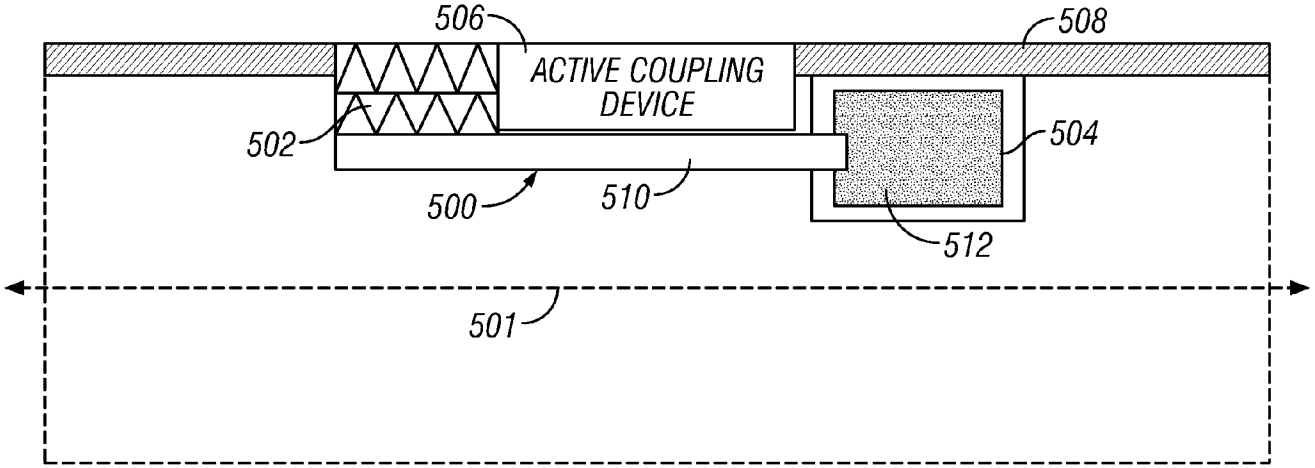
FIG. 4 shows an active vibration control device made according to one embodiment of the present invention that utilizes biasing elements and a damping device.

Referring now to FIG. 4, there is shown a section of an exemplary active vibration control device 500 wherein line 501 represents a drill string longitudinal central axis. The device 500 actively dampens unwanted axial vibrations substantially along the axis 501. By dampening, it is generally meant using existing mass response to beneficially mitigate total vibration. The unit 500 includes one or more biasing elements 502 that transfer compression and tension forces through the device 500 without disabling the freedom of axial travel within the device 500 and a damping chamber 504 that dampens unwanted axial motions.

In one embodiment, the biasing elements 502 includes twin spring elements having a 'K factor' that allows full drilling and over pull forces to be transferred without bottoming or topping out the device 500. In another arrangement, two or more spring elements are coupled in parallel and a controllable coupling device 506 selectively couples a combination of spring devices to the sub housing 508 to create a wide ranging 'K factor' for different operations and to offer an additional degree of active control.

The damping chamber 504 is connected to the biasing element 502 with a shaft 510. The damping chamber 504 can include a controllable fluid 512. By altering a material property of the controllable fluid 512, the coefficient of damping provided by the chamber 504 can be increased or decreased. Thus, axial displacement and velocity of displacement can be user defined and actively controlled via the control unit 60 (FIG. 3) with appropriate control signals. By controlling combinations of displacement and velocity, the control unit 60 (FIG. 3) can control axial vibrations and resulting accelerations.

Figure 5:
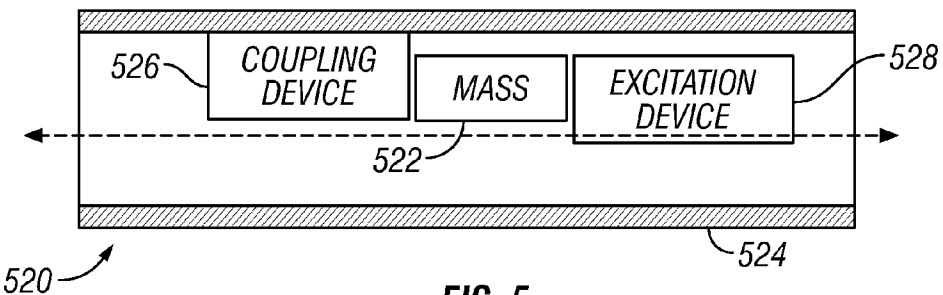
FIG. 5 shows an active vibration control device made according to one embodiment of the present invention that utilizes a vibrating mass that is selectively coupled to a drill string.

Referring now to FIG. 5, there is shown an embodiment of an active vibration control device 520 that mitigates unwanted vibrations by adding energy in the form of axial vibrations to a BHA and/or drill string. The device 520 includes a mass 522 that is selectively coupled to the drill string 524 with a coupling device 526. An excitation device 528 causes the mass 522 to oscillate along an axis co-linear to the axis of the drill string 524. The mass 522 can be driven by an external source 528 as shown or an internal source. In one embodiment, the excitation device 528 causes the mass 522 to oscillate in a resonance manner. The energy input from the excitation device 528 offsets frictional damping and replaces the energy used for active control in a timely manner.

The device 520 can be controlled by a calculation engine module in a control unit 60 (FIG. 3) as discussed above. In response to the calculation engine module commands, the coupling device 526 temporarily couples the moving mass 522 to the drill string 524. The coupling device 526 can control the degree and duration of the coupling of the mass 522 to the drill string 524. That is, using devices such as controllable materials, the coupling device can "lock" the mass 522 to the drill string 524 such that there is no relative movement or allow a limited amount of relative movement or slip between the mass 522 and the drill string 524. The degree of coupling and the duration of the coupling control the energy transferred from the moving suspended mass 522 into the drill string 524. If the mass 522 and drill string 524 traveled in a common direction, then the energy is additive and could be used to impart a user selected motion/vibration. If the mass 522 and drill string 524 move in opposing directions, then coupling action would be subtractive and motion/vibrations would be actively cancelled or caused to be 'out of phase' with the drill string or BHA.

In some embodiments, a plurality of devices 520 are coupled together and controlled by one calculation engine module. Using a multiple set of stacked devices 520 can extend the range of available energy input (e.g., by the additive effect of the mass, velocity and direction).

The active axial device 520 can be used to cancel drill string motion such as unwanted bit bounce or could be used to actively induce axial forces at the drill bit to create a percussion effect. Using the device 520 in conjunction with passive or active damping and/or coupling device can allow a small section of the drill string to oscillate axially as desired (e.g., the drill bit), while the remainder of the string remained more or less axially fixed. In this case, the resulting axial 'hammer' can be located near the drill bit and decoupled from the drill string by placing a damping device above and between the axial hammer and the remainder of the BHA.

In another embodiment not shown, an axial hammer includes a mass suspended on a system of biasing members (complex springs) such that the mass oscillates axially and in a torsional mode. In one mode, the mass can be suspended to allow free rotation in only one direction while axially oscillating. During use, upon appropriate signals from the calculation engine module, a coupling device couples the mass to the system and imparts an axial and rotational impulse to the system. Selective coupling and/or selective rotation coupled with the axial hammer discussed above can produce a vertical and rotational impulse to the drill bit.

The coupling device 526 can be made in a number of embodiments. In one embodiment, controllable fluids such as MR or ER fluids are selectively energized with current to connect the mass 522 to the drill string 524. In another embodiment, magnets and electric coils are selectively energized to produce magnetic forces that connect the mass 522 to the drill string either directly or via MR/ER fluids. In still another embodiment, a mechanical clutch or MR/ER fluids coupled with slotted devices like 'level-wind' shafts can be utilized.

Figure 6:
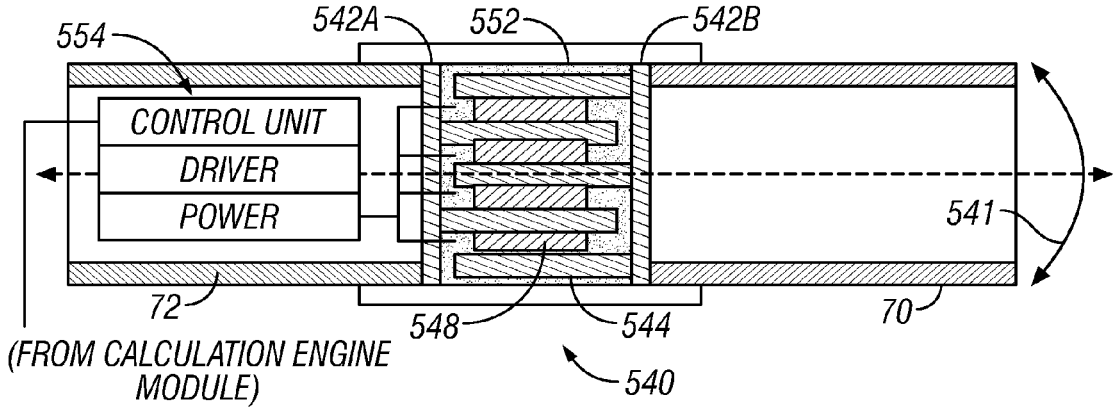
FIG. 6 shows an active vibration control device made according to one embodiment of the present invention that controls torsional oscillations utilizing selectively coupled interlocking claws.

Referring now to FIG. 6, there is shown an exemplary active torsional damping device 540 for managing torsional vibrations 541. The device 540 is formed in a fashion somewhat resembling a LOVEJOY style claw coupling and includes couplings 542A,B, each of which have mating circumferentially spaced-apart claws 544. The device 540 has a hollow bore (not shown) and is connected at one end to a driving upper sub 70 and connected at another end to a driven lower sub 72. The claws 544 of each coupling 542A,B are connected with biasing elements 548 such as compression springs so that when torque is applied in either direction, one half of the biasing elements 548 are compressed and one half are partially unloaded. The summation of the 'k' factors for the biasing elements 548 determines the torsional stiffness as defined by radians of rotation per unit torque applied. Voids and passages within and around the biasing elements 548 are filled with a controllable fluid 552. Changing a material property such as the stiffness or viscosity of the controllable fluid 552 adjusts the rate of loading or unloading of the biasing elements 548. Thus, for example, a momentary decrease in stiffness can cause a corresponding momentary decrease in the rate of rotation between the upper sub 70 and lower sub 72, which can be used to dampen torsional shock loads and forces in a manner previously described. A suitable signal such as electrical current or a magnetic field is applied to the controllable fluid 552 by a control system 554 that includes a control unit, a driver and a power source in a manner previously described. The control unit can be the same as control unit 60 (FIG. 3) or a separate control unit.

In one variation to the above-described embodiment, a fluid of fixed property flows via a flow circuit between a pair of chambers configured such that one chamber can increase in volume when the other chamber decreases in volume to thereby permit momentary relative rotation between the upper and lower subs 70,72. A controllable element associated with a flow restrictor can be used to actively change the flow rate in the flow circuit.

In another variation, the biasing elements include pairs of bow or leaf spring whose long axis is aligned with the axis of the drill string. System functionality remains the same and all aspects of the fluid damping elements remain the same.

Figure 7:
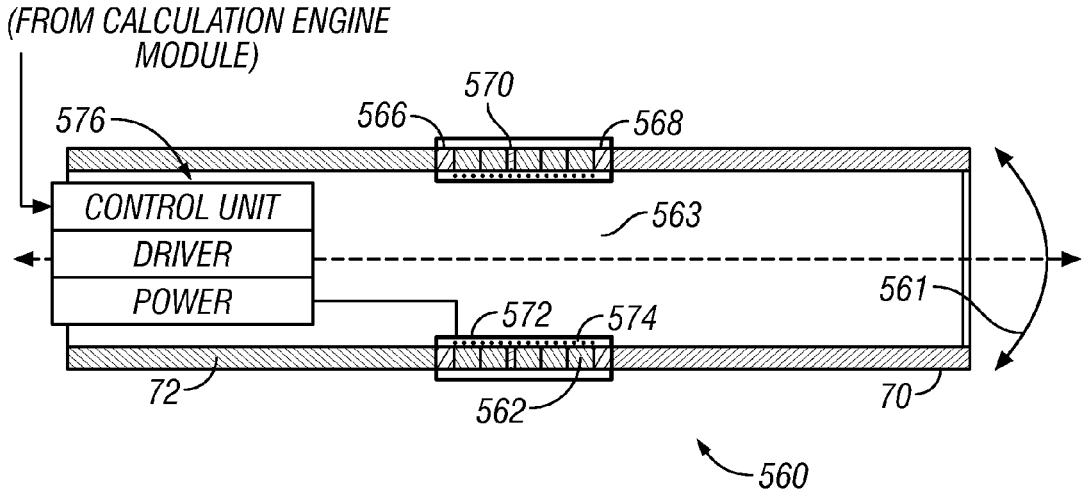
FIG. 7 shows an active vibration control device made according to one embodiment of the present invention that controls torsional oscillations utilizing one or more friction disks.

Referring now to FIG. 7, there is shown another active torsional vibration device 560 that utilizes one or more friction disks 562 to control torsional vibrations 561. The device 560 has a hollow bore 563 and is connected at one end to a driving upper sub 70 and connected at another end to a driven lower sub 72. The disks 562 have a rotation axis that is aligned with the drill string axis. Drill string axial forces pass through the device 560 and do not substantially affect the behavior of the torsional aspects of the device 560. The single or stack of multiple friction disks 562 can be loaded by a passive spring force unit 566 similar to a clutch in an automotive application. The disks 562 can also be loaded with an active loading device 568 to control the maximum torque transmitted and the moment-by-moment torque to control of torsional events. Additionally, one or more passive torsionally loaded springs 570 can be disposed within the disk stack 562 to dampen start-up and other peak shock loads and to allow a small degree of relative rotation between the upper and lower subs 70,72 as well as between pairs of adjacent disks 562. In some embodiments, additional active damping is provided by placing the disks 562 within a closed and sealed chamber 572 that is filled with a controllable fluid 574. Actively changing the properties (viscosity and/or shear strength) of these fluids provides corresponding active control over the rate of disk slippage between the clutch disks 562 and the end subs 70,72. For example, changing a material property such as the stiffness, length or viscosity of the controllable fluid adjusts the rate of slippage between the disks 562 that can cause a corresponding momentary change in the rate of rotation between the upper and lower sub, which can be used to dampen torsional shock loads and forces in a manner previously described. Sensors (not shown) are appropriately positioned to determine the relative motion of the device and its components. Thus, in one sense, a preset amount of slippage is designed into the system so that reduction of that slippage can be used to beneficially add vibration into the drill string. A suitable signal such as electrical current or a magnetic field is applied to the controllable fluid 574 by a control system 576 that includes a control unit, a driver and a power source in a manner previously described. The control unit can be the same as control unit 60 (FIG. 3) or a separate control unit.

Figure 8:
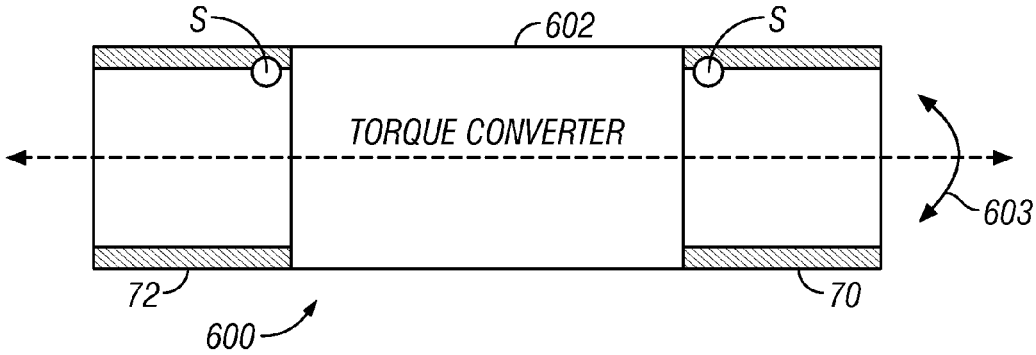
FIG. 8 shows an active vibration control device made according to one embodiment of the present invention that controls torsional oscillations utilizing a torque converter.

Referring now to FIG. 8, another active vibration control device 600 includes a fluid drive torque converter 602 for controlling torsional vibrations 603. Drill string axial forces pass through the device 600 and do not substantially affect the behavior of the torsional aspects of the device 600. The torque converter is positioned between the upper driving sub 70 and the lower driven sub 72 of the device 600. Sensors S include motion or speed sensors to determine relative motions such as speed, velocity, acceleration. The fluid torque converter 600 controls the torsional coupling of the sub 70,72 with a controllable fluid having a property such as stiffness or viscosity that can be adjusted. Application of control signals to the controllable fluid properties increases the amount of torque transmitted across the device by increasing the shear strength of the fluid. In one embodiment, when the controllable fluid is in the 'off condition' the driven sub remains stalled does not rotate if the driving sub rotates in a pre-determined range (e.g., 0 and 300 RPM). In this 'off' condition, no rotation or practical torque is transmitted across the device. When the controllable fluid is in the 'on condition', a high shear strength gel, the torque converter becomes semi-solid and is considered to be in a locked mode, normal drilling condition. In the 'on condition', controlled reduction of the gel strength (high frequency change from strong to weaker shear strength) by appropriate application of control signals can allow the torque converter to momentarily 'slip' (a fraction of a rotation), which can be used to dampen torsional shock loads and forces in a manner previously described.

Two common drill string torsional excitation modes are cyclic torsional vibrations from the drill bit and momentary sticking of the drill string to the bore hole wall, which is generally known as stick-slip. In both cases, the drilling string will torsionally bounce or oscillate while rotating at an average rotary rpm. Devices made in accordance with the present invention can be used to minimize, negate or arrest these torsional oscillations. Further, the imparting of beneficial torsional oscillations can be used to enhance cutting efficiency of the drill bit, which is discussed in commonly assigned and co-pending application titled "Improving Drilling Efficiency Through Beneficial Management Of Rock Stress Levels Via Controlled Oscillations Of Subterranean Cutting Elements", U.S. Ser. No. 11/038,889, filed on Jan. 20, 2005, which is hereby incorporated by reference for all purposes.

Exemplary devices to actively control and manage or impart beneficial torsional vibrations into the drill string include torque converter based systems, high speed and high density mass flywheel systems, and torsional spring mass devices.

Referring still to FIG. 8, a torque converter 600 using a controllable fluid such as MR or ER fluids can provide both low speed and small outer diameter. A relatively small outer diameter can be useful in slim hole applications. In one application, selective or controlled application of current flow to the controllable fluid causes the torque converter 600 to operate at just barely 'lock-up'. To remove a torsional skip or a cyclic torsional event, a control unit 60 (FIG. 3) associated with the torque converter 600 reduces the current flow to the ER fluid and allows the spike to be absorbed by a short term, low level 'slip' within the torque converter 600. Cyclic events would be treated the same manner. The control unit and torque converter cooperate to manage the current flow so that the torque converter 600 is coupled just hard enough to absorb the cyclic vibration spikes, but to minimize unnecessary slippage.

In another application, the torque converter 600 can create beneficial torsional vibrations by allowing a baseline degree of continuous slip across the driven sub 72 versus the driving sub 70. Depending on the degree of slip, a heat rejection exchanger (not shown) could be required. A low level of slip can be established by selecting an ER fluid current value that results in, for example, a ten to fifteen percent average slip. After a time and frequency is determined by the control unit 60 (FIG. 3), the control unit transmits control signals to the torque converter 600. These control signal can be an applied current to the controllable fluid that momentarily remove most, if not all, of the slip. This would cause a slight speed increase in the driven sub 72 and apply a spike torque (torsional) vibration. Sensors (not shown) are appropriately positioned to determine the relative motion of the device and its components.

The torsional vibrations spikes imparted above could be used independently or together with other disclosed devices to produce beneficial vibrations of the drill bit. The concurrent use of dampers in the system could prevent these induced vibrations from reaching other components within the drilling assembly.

The low level continuous slip torque converter disclosed above could also be used to remove other torsional vibrations by allowing the base line slip ratio to continually vary as required. If the slip was increased to be greater than the base line, then damping of other torsional string vibrations would occur. As noted above, reducing the base line slip would induce a torsional force. Thus, an appropriately programmed control unit could in real-time modulate the current supplied to the ER fluid so as to create a selected torque and speed pattern on the driven shaft regardless of input shaft speed fluctuations. The methodology of additive and subtractive superposition allows a single torque converter device to create a wide range of driven shaft behavior, from 'dead' smooth, to 'square wave' rough. Appropriately positioned motion sensors can be used to provide data regarding the relative movement of the several components.

Additionally, flywheel systems operating at high speed and having high mass spinning cylinders made of high density material, coupled with MR or ER fluids can be used to both damp and excite torsional behavior in a drilling assembly.

Figure 9:
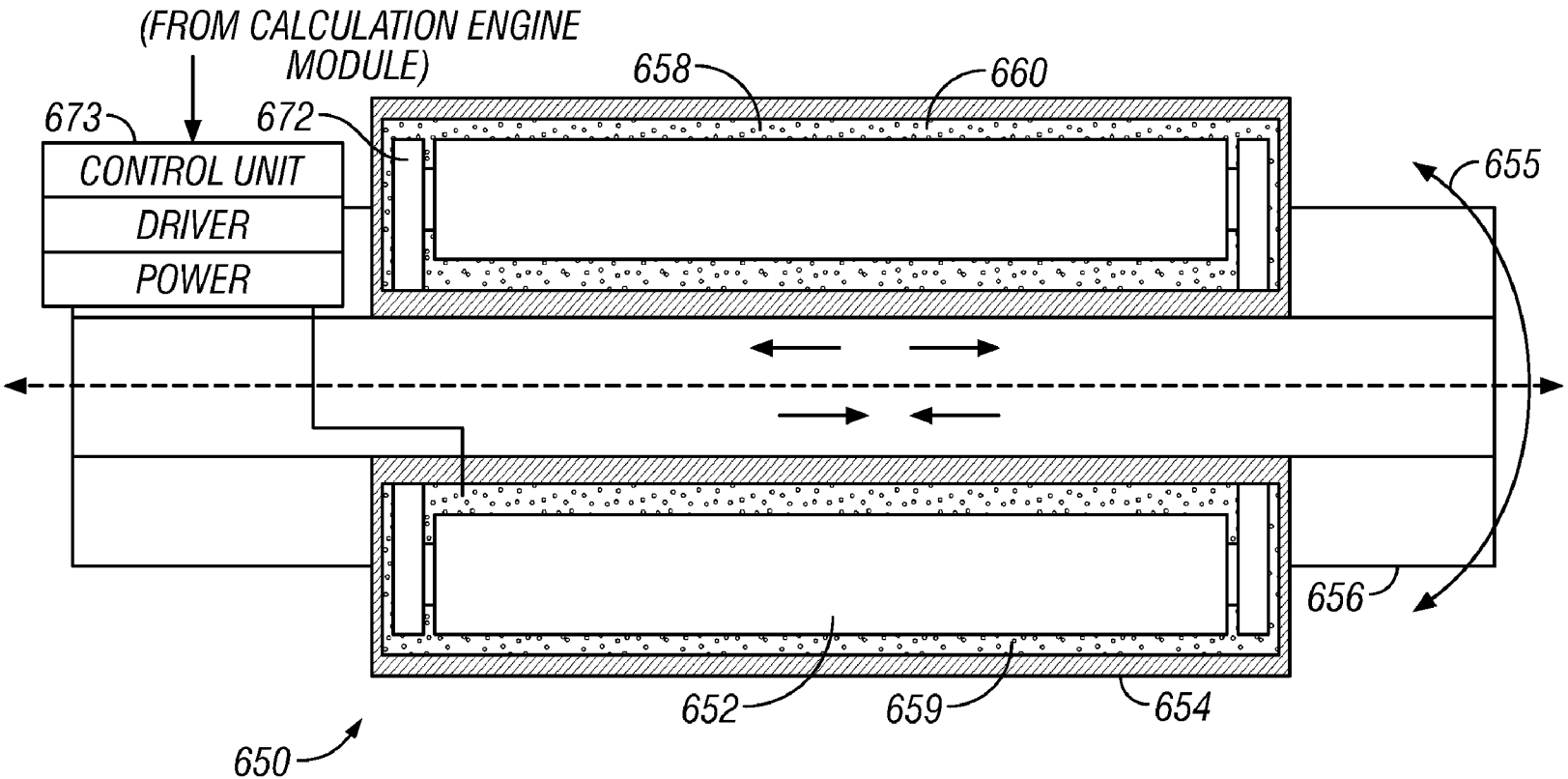
FIG. 9 shows an active vibration control device made according to one embodiment of the present invention that controls torsional oscillations utilizing a spinning mass that is selectively coupled to a drill string.

Referring now to FIG. 9, in one embodiment, the flywheel device 650 includes a toroidal cylinder 652 spinning at high speed within a sub 654 placed in a section of a drill string 656. The device 650 provides controlled torsional oscillations 655. The cylinder 652 rotates about the long axis of the drill string 656 within an annular space 658 between the inner diameter and outer diameter of the sub 654. The space 658 is filled with a controllable fluid 659 with a relatively low viscosity when the fluid is in the 'off' condition. A control unit 60 (FIG. 3) applies a control signal that selectively increases the viscosity of the controllable fluid 659, which increases the drag between the cylinder 652 and the sub 654. Applying the control signals in a controlled manner momentarily couples the spinning cylinder 652 to the sub 654 and thereby imparts energy into the sub 654 and the drill string 658. A rotary power device 672 re-supplies the flywheel drive system with energy at a rate to ensure long term functionality of the flywheel system. A suitable signal such as electrical current or a magnetic field is applied to the controllable fluid 659 by a control system 673 that includes a control unit, a driver and a power source in a manner previously described. The control unit can be the same as control unit 60 (FIG. 1) or a separate control unit.

The cylinder 652 can rotate in the same direction of the rotation of the drill string 658 or rotate counter to the direction of the rotation of the drill string 658. If both rotations are the same, the momentary coupling creates a torque or speed spike. In a counter rotation scenario, momentary coupling dampens torque or speed spike in the direction of the string rotation. Also, a pair of controlled coupled counter spinning flywheels can be used to arrest torsional vibrations in either direction.

In another embodiment, a semi-active to passive version of the FIG. 9 device uses a thixotropic fluid with appropriate properties. Such appropriate properties include movements and accelerations greater than a predetermined value of the drilling string can cause the fluid to thicken and damp or arrest these movements. An equilibrium condition would result as a function of the fluid properties and movement of the drill string within the stabilizer shell. Selecting the fluid properties so that the equilibrium condition movements were acceptable would then create a semi-active drill string oscillation arrester.

Figure 10:
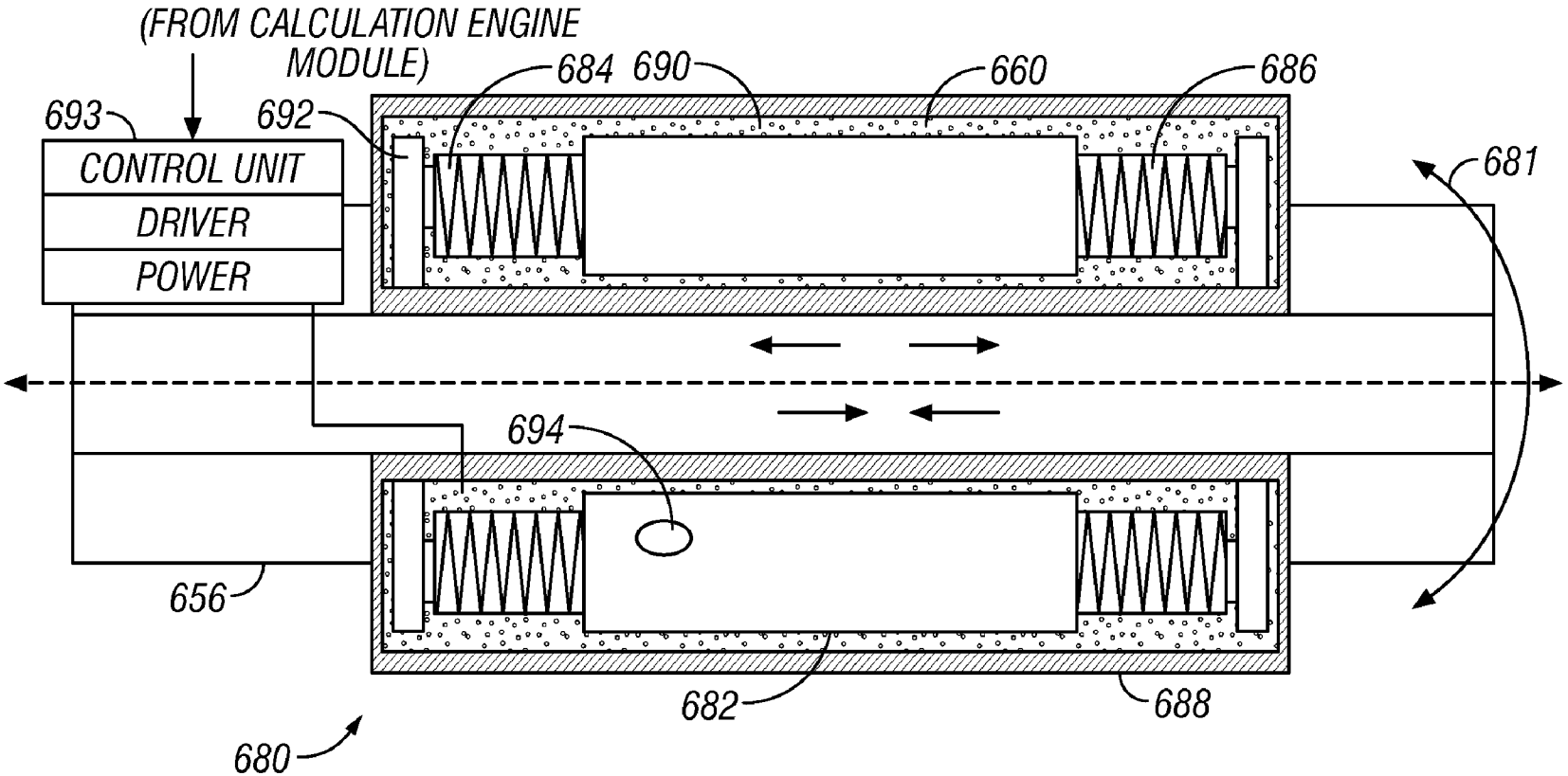
FIG. 10 shows an active vibration control device made according to one embodiment of the present invention that imparts oscillations utilizing an oscillating mass that is selectively coupled to a drill string.

Referring now to FIG. 10, in another embodiment, an active torsional control device 680 for applying torsional oscillations 681 can include a dense and heavy cylindrical mass 682 mounted between two counter wound torsional springs 684,686 and placed in an annular sub 688 such that it is free to rotate in an oscillatory fashion around an axis parallel to the long axis of the drill string or BHA 656. A controllable fluid 690, such as an ER or MR fluid, surrounds the mass 682 and springs 684,686. An energy source 692, external or internal, keeps the mass 682 torsionally oscillating by offsetting the frictional energy losses from the springs 684, 686 and controllable fluid 690. The energy source 692 can also be used to initiate movement of the mass 682. As discussed above, the control unit 60 (FIG. 3) determines the energy level needed to damp or control certain or series of torsional vibrations. Sensors 694 monitor the direction and angular velocity of the torsional mass 682 or masses and this information is used by the control unit 60 (FIG. 3) to determine and calculate the required degree of coupling between the torsional mass 682 and the sub 688, which is connected to the drill string 656. A suitable signal such as electrical current or a magnetic field is applied to the controllable fluid 690 by a control system 693 that includes a control unit, a driver and a power source in a manner previously described. The control unit can be the same as control unit 60 (FIG. 3) or a separate control unit. A suitable signal such as electrical current or a magnetic field is applied to the controllable fluid 690 by a control system 693 that includes a control unit, a driver and a power source in a manner previously described. The control unit can be the same as control unit 60 (FIG. 3) or a separate control unit.

In some embodiments, several units are employed and controlled by the control unit 60 (FIG. 3). The control unit 60 (FIG. 3) determines which unit or units to couple to the drill string to provide the desired results. Suitable sensors can provide mass angular velocity and rotation direction information to the control unit 60 (FIG. 3) to select the appropriate unit to couple. Additionally, each unit can have different torsional resonance frequencies to increase the band width (frequency response range) the down hole system could effectively respond to.

As disclosed above, the torsional mass device could be independent or integral to one or more of the devices and systems discussed within.

Additionally, the active torsional control device 680 can be used to impart beneficial torsional vibrations to the bit to improve drilling performance or efficiency. To continually add energy to keep the torsional spring and mass arrangement 'fully charged, a magnetic/coil interface (not shown) driven by an external or internal power source is can be used. In another arrangement, a hydraulic fluid powered device using a bleed stream from the high pressure drilling fluid can be used. In this case the hydraulic drive is coupled and selectively clutched (e.g., by using MR or ER fluids) to supply a torque to the mass when the mass is moving in the same direction as the hydraulic drive output. The energy level required can be extracted from the drilling fluid. This same arrangement can be used to re-supply energy to the axial mass system as well.

Further, the active torsional device can be used to cancel drill string motion, say unwanted string torsional oscillations or could be used to actively induce rotational forces at the bit to create a rotary percussion effect. One skilled in the art would also see many other cancellation and impartation actions this device could produce. The use of this device along with passive or active damping device could allow a small section of the drill string to oscillate rotationally as desired, say the bit, while the remainder of the string remained more or less torsionally stable relative to the primary string rotation. In this case a rotary 'hammer' would be located near the bit and decoupled for the string by placing a torsional damping device above and between the rotary hammer and the remainder of the BHA.

Drill string whirl behavior is characterized by a circular movement of the drill string within the borehole. This can be visualized as a buckled column spinning in the buckled condition where the bore hole wall acts to limit the displacement of the buckle. The speed of the whirl or rotating buckled column is typically slower than the rotation of the drill string and is often minimized by close relative diameters of the bore hole and components of the drill string.

Embodiments of the present invention can also be advantageously used to control whirling of the drill string. Whirling of the drill string damages, the bore hole wall, the drill string and at times components of tools within the drill string. Several operational and configuration procedures have been development over the years to minimize whirl and whirl related damage. However, most of these provisions tend to reduce drilling efficiency and alter the optimum way in which the well bore could be drilled. A means to actively damp whirl only when whirl was present would be beneficial.

Active Drill String Whirl Damping Devices as discussed herein sense and actively damp whirl. These devices can be independent or integral to other active devices. Additionally, these devices can be placed in single or multiple locations along the drill string and bottom hole assembly. The device could be controlled and driven by the control unit 60 (FIG. 3) or could be self sensing and self powered.

Figure 11:
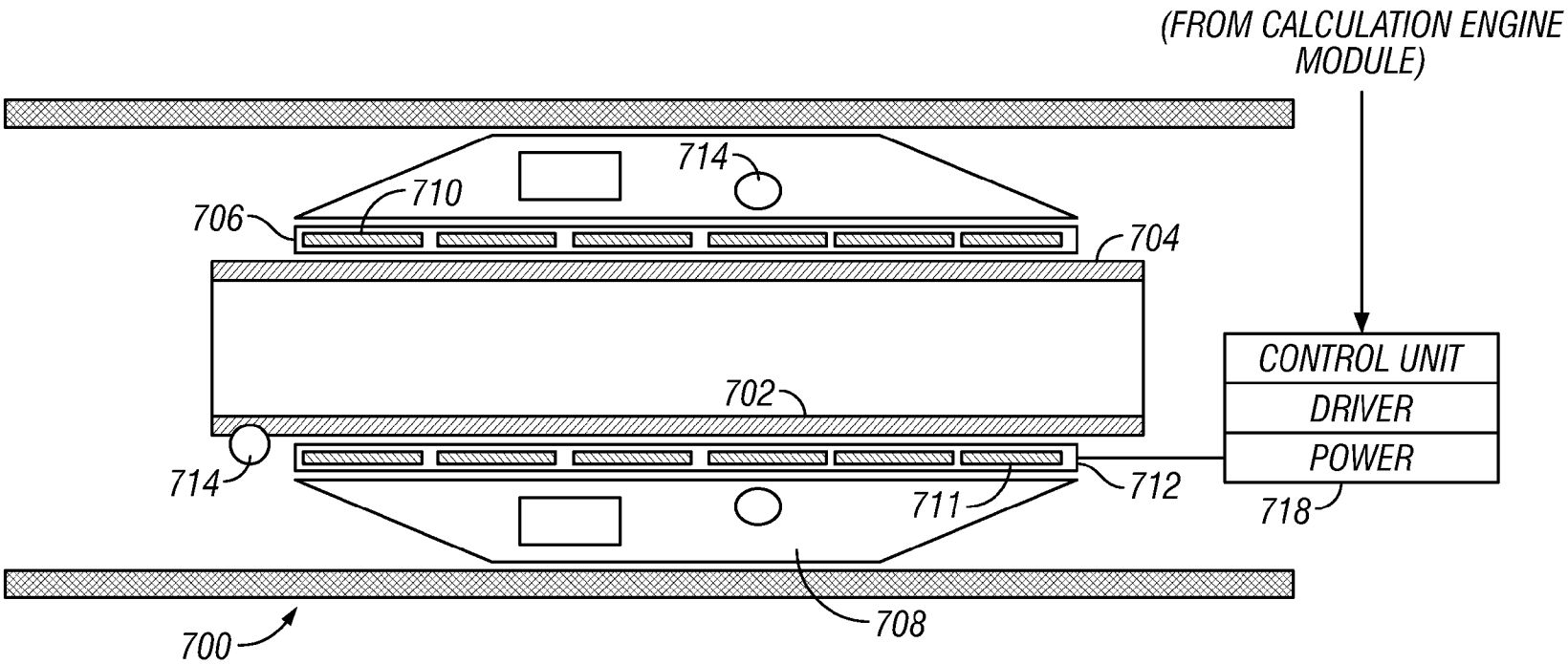
FIG. 11 shows an active whirl control device made according to one embodiment of the present invention.

Referring now to FIG. 11, in one embodiment, an active whirl control device 700 is formed generally as a near full gage drill string stabilizer that is not rigidly attached to the drill pipe or tubular body 702. The device 700 has a hollow central bore 704 adapted to receive one or more coupling elements 706 that actively connect the device 700 to the drill string 702. The device 700 is axially and torsonally attached to the drill string 702 to resist drilling forces and movements in these planes, but allows the drill string 702 to 'wobble' such that the device axial center and drilling string axial center do not have to be collinear. The nature of this coupling arrangement can be characterized as "laterally free within limits". The device 700 also includes contact pads 708 that are relatively short and close to full gage; i.e., stabilizer pads.

The "laterally free" behavior is controlled by a group of chambers 710 dispersed circumferentially in an annular space 712 separating the drill pipe 702 and the device 700. The chambers 710, which can also be cylinders or link-like members, expand or contract as needed to dampen or stop the drill string 702 from whirling. In a manner previously described, the chambers 710 or cylinders are filled with a controllable fluid 711 such as MR or ER fluids. Using a control signal such as electrical current, the properties of these fluids and the flow of these fluids between chambers 710 or cylinders are actively altered in a manner previously described to affect the damping action.

In some embodiments, sensors 714 are placed in and around the chambers 710 to monitor and allow real-time control of the active and self-contained whirl damping device. These sensors 714 monitor conditions within the device, the movement of the drilling string 702 or both. Additionally, devices such as PZT modules or micro machines (not shown) can be imbedded in and around fluid flow ports (not shown) or within the chambers 710. Movement of the drill string 702 within the device could produce some or all of the power needed to actively operate the device 700. Excess power can be stored (batteries or capacitors) within the device or coupled to and supplied to other downhole devices. A suitable signal such as electrical current or a magnetic field is applied to the controllable fluid 711 by a control system 718 that includes a control unit, a driver and a power source in a manner previously described. The control unit can be the same as control unit 60 (FIG. 3) or a separate control unit.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. For example, some embodiments can combine spinning and axial masses within the same device to produce a desired combined effect. It is intended that the following claims be interpreted to embrace all such modifications and changes.

The invention claimed is:

1. An apparatus for controlling vibration of a tubular disposed in a wellbore, comprising:

an active vibration control device coupled to the tubular, the active vibration control device including a plurality of members coupled to at least one biasing member positioned to move within a controllable material having a variable stiffness, the active vibration control device controlling a vibration in the tubular when the stiffness of the controllable material is changed.

2. The apparatus according to claim 1, wherein the active vibration control device controls one of (i) a loading, and (ii) unloading of the at least one biasing member to control vibration.

3. The apparatus according to claim 1, wherein the controllable fluid is one of (i) a smart fluid, and (ii) a smart material.

4. The apparatus according to claim 1, wherein the active vibration control device includes a coupling having at least an upper portion and a lower portion wherein each portion is connected to the tubular.

5. The apparatus according to claim 1, wherein the plurality of members includes a coupling having at least an upper portion and a lower portion, wherein each portion includes a claw.

6. The apparatus according to claim 1 wherein the plurality of members includes a coupling having at least an upper portion and a lower portion, and a plurality of biasing members interposed between the upper portion and the lower portion, the plurality of biasing elements being configured to include one of: (i) an adjustable rate of loading, and (ii) an adjustable rate of unloading.

7. The apparatus of claim 1 further comprising:

a controller including a computer program to (i) process data to determine whether a non-beneficial condition exists in the wellbore tubular, and (ii) control the active vibration control device to mitigate the non-beneficial condition.

8. A method for controlling vibration in a tubular disposed in a wellbore, comprising:

coupling an active vibration control device to the tubular, the active vibration device including a plurality of members coupled to at least one biasing member positioned to move within a controllable material having a variable stiffness that enables the active vibration control device to control the vibration in the tubular; and operating the active vibration control device to control the vibration in the tubular by varying stiffness of the controllable material.

9. The method according to claim 8 further comprising:

measuring at least one selected parameter of interest relating to one of: (i) the tubular, and (ii) a bottomhole assembly connected to the tubular, and varying the stiffness of the controllable material in response to the measured parameter.

10. The method according to claim 9 wherein the at least one selected parameter is one of: (i) axial vibration, (ii) torsional vibration, (iii) drill string whirl, (iv) bit bounce, (v) slip-stick; and (vi) lateral vibration.

11. The method according to claim 9 wherein the active vibration device varies the stiffness of the controllable material that reduces the measured value of the at least one selected parameter.

12. The method according to claim 8 wherein the plurality of members includes a coupling having at least an upper portion and a lower portion, the method further comprising:

connecting each portion to a section of the tubular; and connecting the upper portion to the lower portion with claws.

13. The method of claim 8 wherein the plurality of members includes a coupling having at least an upper portion and a lower portion, the method further comprising:

disposing a plurality of biasing members between the upper portion and the lower portion; and adjusting one of: (i) a rate of loading, and (ii) a rate of unloading for at least one of the plurality of biasing members.

* * * * *